US005718110A

United States Patent [19]

Stahlecker

[11] Patent Number: 5,718,110

[45] Date of Patent: Feb. 17, 1998

[54] ARRANGEMENT FOR OPEN-END ROTOR SPINNING

[75] Inventor: Gerd Stahlecker, Eislingen, Germany

[73] Assignee: Novibra GmbH, Owen, Germany

[21] Appl. No.: 618,384

[22] Filed: Mar. 19, 1996

Related U.S. Application Data

[63] Continuation-in-part of Ser. No. 195,463, Feb. 14, 1994, abandoned.

[30] Foreign Application Priority Data

Feb. 12, 1993 [DE] Germany ..... 43 04 151.5

[51] Int. Cl.[6] ..... D01H 4/00

[52] U.S. Cl. ..... 57/416; 57/404; 57/408; 57/411; 57/415

[58] Field of Search ..... 57/404, 408, 411, 57/415, 416, 414

[56] References Cited

U.S. PATENT DOCUMENTS

| | | | |
|---|---|---|---|
| 3,368,339 | 2/1968 | Negishi | 57/416 |
| 3,523,300 | 8/1970 | Tabata et al. | 57/416 |
| 3,875,731 | 4/1975 | Khomyakov et al. | 57/414 |
| 4,663,929 | 5/1987 | Raasch et al. | 57/416 |
| 4,665,687 | 5/1987 | Ott et al. | 57/414 |

FOREIGN PATENT DOCUMENTS

| | | | |
|---|---|---|---|
| 1510714 | 4/1970 | Germany . | |
| 1710042 | 7/1971 | Germany . | |
| 2158087 | 7/1972 | Germany | 57/416 |
| 3429512 | 2/1986 | Germany | 57/416 |
| 3636182 | 4/1988 | Germany . | |
| 4-343722 | 11/1992 | Japan | 57/416 |
| 1201288 | 8/1970 | United Kingdom . | |

*Primary Examiner*—William Stryjewski

*Attorney, Agent, or Firm*—Evenson McKeown Edwards & Lenahan, PLLC

[57] ABSTRACT

In the case of a device for open-end rotor spinning with a spinning rotor, the spinning rotor is provided with a fiber collecting groove and a fiber sliding surface. The fiber sliding surface is provided with structured areas which are set in the opposite sense of rotation to the spinning rotor, viewed in the direction towards the fiber collecting groove. The mouth of a fiber feed duct is disposed facing the structured areas with a component in the sense of rotation of the spinning rotor. Due to the way they are arranged, the structured areas, which cross the path of the fibers, exert a propelling force on the fibers in the direction of the fiber collecting groove. The sliding of the fibers into the fiber collecting groove does not take place exclusively by means of the centrifugal forces anymore, so that in design the traditional angle of taper of the fiber sliding surface is not necessary.

24 Claims, 8 Drawing Sheets

ARRANGEMENT FOR OPEN-END ROTOR SPINNING

This is a continuation-in-part application of application Ser. No. 08/195,463 filed Feb. 14, 1994, now abandoned.

BACKGROUND AND SUMMARY OF THE INVENTION

The invention relates to an arrangement for open-end spinning with a spinning rotor provided with a fiber collecting groove and a fiber sliding surface. The sliding surface is provided with at least one structured area inclined in relation to the plane of the fiber collecting groove, while the mouth of a fiber feed duct is disposed opposite the fiber sliding surface at a distance from the fiber collecting groove and in the sense of rotation of the spinning rotor.

In open-end spinning, delivered fibers which reach the fiber sliding surface of a spinning rotor are first deflected in the sense of rotation of the spinning rotor and thereby accelerated and then delivered along the fiber sliding surface to the fiber collecting groove. It is current general knowledge that the fibers slide in a significant slope on the fiber sliding surface into the fiber collecting groove. The reason for this is that the fibers as a rule are already touching the fiber sliding surface with their leading ends, while the trailing ends are still in the mouth of the fiber feed duct. It is therefore presumed that the fibers reach the fiber collecting groove with their leading ends first, while the trailing ends are still on the fiber sliding surface.

In the course of developing ever-increasing numbers of revolutions for spinning rotors, the diameter of the spinning rotor has become smaller. Therefore it was necessary to make the fiber sliding surface, normally expanding conically to the fiber collecting groove, increasingly steeper, so that a big enough opening would remain for inserting the mouth of the fiber feed duct into the interior chamber of the spinning rotor. However, the steeper the fiber sliding surface, that is, the more its angle of taper approaches a cylindrical surface, the lower the component of centrifugal force will-be, whose function up to now has been mainly the delivering of fibers into the fiber collecting groove. With smaller spinning rotors, such as rotors with collecting groove diameters of less than 30 mm, there is consequently the danger that the sliding movement of the fibers on the fiber sliding surface is not sufficiently uniform anymore and that yarn defects can occur.

From the German published patent application 34 29 512 A1 an arrangement as mentioned above is known which comprises a spinning rotor, the fiber sliding surface of which, while expanding conically towards the fiber collecting groove, is provided with a structured surface in the form of spiral lines, whose slippage resistance decreases towards the fiber collecting groove. This known publication presumes, incorrectly, that the fibers which reach the fiber sliding surface are immediately taken along without any great slip, whereby they are then transported particularly quickly to the fiber collecting groove because of the decreasing slippage resistance. This known publication does not give any details about the angle of inclination of the spiral lines in relation to the sense of rotation of the spinning rotor.

From the German published patent application 21 58 087 it is known that the fiber sliding surface, which expands conically towards the fiber collecting groove of the spinning rotor, is provided with concentric notches or projections, which extend approximately parallel to the fiber collecting groove, or when required also in the form of a slightly inclined helix. With this prior art, it is accepted that there is a significant difference in the velocities between the fiber sliding surface and the fibers reaching it, which results in a bigger slip. With the known arrangement, attempts are made to make the friction in axial direction of the fiber sliding surface greater than in circumferential direction, so that the spiral path of the fibers sliding on the fiber sliding surface towards the fiber collecting groove is made longer. The increased time span should enable the fibers to be accelerated to the circumferential velocity of the fiber sliding surface. Neither are there any details in regard to the angle of slope of the helical line structure in relation to the sense of rotation of the spinning rotor in this publication. Experience has shown that it is not advantageous for the quality of the yarn when the fiber sliding surface is provided with grooves extending almost parallel to the fiber collecting surface.

From the German published patent application 15 10 714 a non-generic prior art is known, which describes a slightly bi-conical shaped open-end spinning pipe without a fiber collecting groove, that is, a spinning element which can be seen as the forerunner of the current spinning rotors. Fibers stream through this spinning pipe, whereby the fibers adhere to the wall due to centrifugal force. The wall is provided with a screw thread, whereby the fibers are forwarded in axial direction of the spinning pipe. The required relative velocity between the wall and the fibers is achieved in that the wall is perforated. Air currents, which retard the fibers, can get in through the perforations into the inside of the spinning pipe. This type of spinning pipe is not provided with a fiber feed duct disposed to supply fibers against the fiber sliding surface.

An object of the invention is to ensure that the fibers reach the fiber collecting groove quickly and safely, especially for spinning rotors with smaller fiber collecting groove diameters whose fiber sliding surfaces do not have the required angle of taper necessary for sufficient centrifugal force.

This object of the invention is achieved in that the slope of the structured areas, as seen in the direction towards the fiber collecting groove, is set against the sense of rotation of the spinning rotor.

This means that the structured areas cross the path of the fibers which slide at an angle on the fiber sliding surface. The invention is based on the knowledge that the fibers delivered onto the fiber sliding surface are significantly slower than the circumferential speed of the fiber sliding surface at this point. There exists a not insignificant speed difference between the fiber sliding surface and the fibers reaching it. The fibers therefore "swim" first over the fiber sliding surface before being accelerated by the friction forces in circumferential direction of the spinning rotor.

By means of the structured areas according to the invention, the centrifugal forces, which in traditional spinning rotors are used exclusively for the sliding of fibers onto the fiber sliding surface, are now assisted by a further driving force. The structured fiber sliding areas propel the fibers according to the angle of the structured areas in the direction of the fiber collecting groove. This succeeds even with such fiber sliding surfaces where the centrifugal forces do not come into effect. The propelling force can of course only come into effect, as will be described later, when there is a sufficient relative velocity, at least at first, between the fiber sliding surface and the fibers reaching it.

The invention results in a series of advantages. The structured fiber sliding surface according to the invention can be steeper than traditional fiber sliding surfaces, as it is not the centrifugal forces alone which effect a sliding of the fibers into the fiber collecting groove. The opening of the spinning rotor can be made larger on the open side, so that there is enough clearance for inserting a component which contains the mouth of the fiber feed duct. Furthermore the fiber feed duct mouth does not need to project so deeply into the interior chamber of the spinning rotor anymore, so that ultimately the drawing effect on the fibers is increased. As the diameter difference between the fiber collecting groove and the open edge of the rotor can be lessened, it is now possible, without having to make the inlet opening smaller, to have a more advantageous longer fiber sliding surface. The danger that the fibers could reach the fiber collecting groove prematurely, or even without touching the fiber sliding surface, which would impair the yarn quality, is now eliminated. The risk that the fibers, due to a too short fiber sliding surface, could be sucked off over the open edge of the rotor is also avoided. The result is in general a better yarn quality.

The structured areas are formed preferably by elevations and/or notches of the fiber sliding surface. The fibers fit more or less onto the grooved surface and this results (when only by way of suggestion), in a sort of positive coupling. This has the effect that the structured areas, due to the scope of the invention, exert a force on the fibers, and this force is directed with a component towards the fiber collecting surface. The degree of the slope of the structured areas is to be ascertained individually through tests. This also applies to the depth and width of the elevations and/or notches. The advantage of the notches is that part of the air is accelerated, which assists the movement of the fibers.

As an alternative or in addition it can be provided that the structured areas are formed with various coefficients of friction. The structured areas consist then also of lines which cross the direction of the fibers, between which the friction coefficient changes.

In a further development of the invention the structured areas can be a needle-like fitting. This needle-like fitting should be only minimally raised from the fiber sliding surface. It exerts an additional detaching effect on the delivered fibers, similar to that of an opening roller, so that undesirable accumulations of fibers, which can occur when the fibers reach the fiber sliding surface, are reduced.

In a particularly advantageous development of the invention the fiber sliding surface is at least partly formed as a cylindrical surface. Tests have shown that with structured areas according to the invention on purely cylindrical surfaces, on which the centrifugal forces do not have a component directed towards the fiber collecting groove, a propelling of the fibers into the fiber collecting groove is possible. Cylindrical surfaces are significantly easier to make in relation to the structured areas than the conical surfaces. In particular when the first part of the fiber sliding surface is formed as a cylinder surface, this permits an enlarging of the diameter of the inlet opening of the spinning rotor, so that the fiber feed duct can be arranged with an even bigger component in the direction of the circumferential speed of the spinning rotor. In addition the diameter of the mouth of the fiber feed duct can be made as large as is required for a sufficient amount of air.

To this purpose it is provided that the fiber sliding surface at least in the area directly preceding the fiber collecting groove is formed as a conical surface expanding towards the fiber collecting groove. Here it is taken into consideration that the fibers in the proximity of the fiber collecting groove have already absorbed to some degree the acceleration of the fiber sliding surface, whereby the propelling force caused by the structured areas diminishes. It is therefore necessary from this point on that the centrifugal force takes over the delivery of the fibers into the fiber collecting groove.

In a further development of the invention it is provided that the slope of the fiber sliding surface—in the longitudinal section of the spinning rotor—increases towards the fiber collecting groove. Where a relative velocity still exists between the fiber sliding surface and the delivered fibers, where in other words the delivering force of the structured areas is at its strongest, it is here that the fiber sliding surface is steeper than towards the fiber collecting groove, where the delivering force of the structured areas diminishes, and where the assistance of centrifugal force is needed, which grows stronger with increased conicality. The advantage of this is that the diameter of the spinning rotor—otherwise with the same fiber collecting groove diameter—can be made larger at the rotor edge. There is therefore sufficient clearance even with the smallest fiber collecting groove diameters for the insertion of a fiber feed duct as far as the fiber sliding surface. These kind of fiber sliding surfaces, without any structured area however, are known from the German published patent application 17 10 042.

It can be occasionally advantageous when the end of the fiber sliding surface, which is furthest away from the fiber collecting groove, widens conically outwards. In this case the fibers going towards the fiber collecting groove must overcome a slight counteracting force caused by the centrifugal force, which however will be possible due to the strong effect of the structured areas. Such a design of the fiber sliding surface can, in certain circumstances, facilitate the moving away of the cover containing the mouth of the fiber feed duct and covering the open face of the spinning rotor.

In a further development of the invention it can be advantageous when the mouth of the fiber feed duct is disposed in a component, the component partly projecting into the interior chamber of the spinning rotor, which component, in the area of the mouth, reaches almost to the fiber sliding surface and preferably expands conically in axial direction towards the fiber collecting groove, as it is known from German published patent application 36 36 182 A1. In this development, the transport air which comes out of the fiber feed duct, can escape better from the spinning rotor, and it is then certainly avoided that any fibers are shot directly into the fiber collecting groove without contact with the fiber sliding surface.

When appropriate, the component can also be provided with a structured area in the area where it projects into the spinning rotor. This component is stationary. As the air driven by the spinning rotor also moves in a circular direction, an additional structured area at this point can create a spiral air movement, with the aim of transporting the fibers better to the fiber collecting groove. It is also possible in such a case to work with a relatively narrow overflow gap between the component which projects into the spinning rotor and the fiber sliding surface. It is however important in such a case that, at a point which is distant from the mouth of the fiber feed duct, the component is recessed so that the spinning air can escape from the interior chamber of the spinning rotor.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
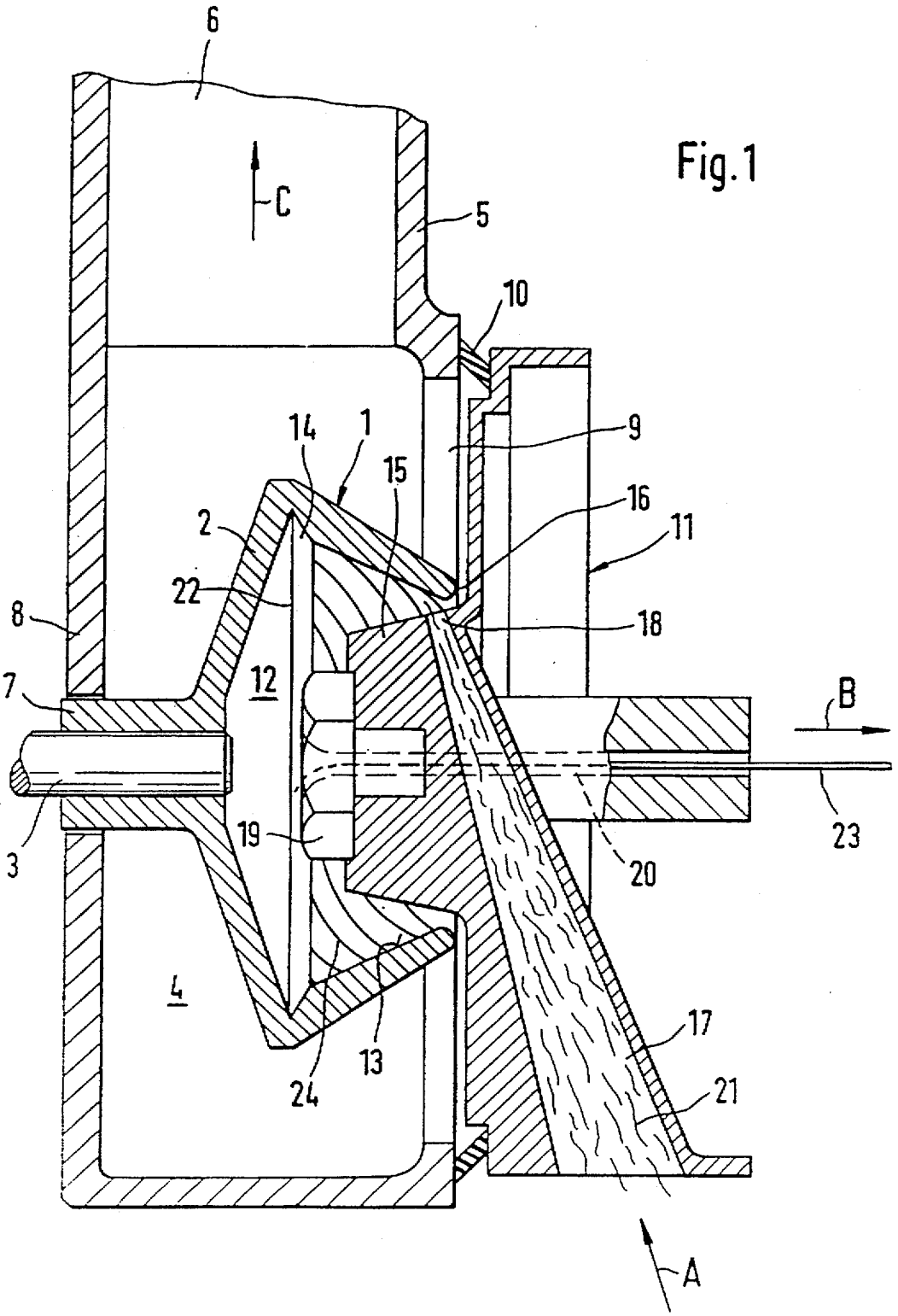
FIG. 1 is an enlarged depiction in longitudinal section through the area of a spinning rotor assembly of an arrangement for open-end rotor spinning, whereby—differing from the mentioned section drawing—the area of a fiber feed duct is also shown in longitudinal section, constructed according to a preferred embodiment of the invention.

The arrangement for open-end rotor spinning according to FIG. 1 includes a spinning rotor assembly 1, comprising mainly a rotor 2 and a rotor shaft 3 rotatable with the rotor 2. The rotor 2 rotates in a vacuum chamber 4, which is formed by a rotor housing 5, the housing 5 being attached to a vacuum source (not shown) by means of a suction line 6, which creates an air stream that flows in arrow direction C. The rotor 2 is connected to a collar 7 which incorporates the rotor shaft 3, the collar 7 being sealed and penetrating the back wall 8 of the rotor housing 5, whereby the shaft 3 is running in bearings and driven outside the vacuum chamber 4 (not shown).

The rotor housing 5 has an opening 9 on its operational side which can be closed, through which the spinning rotor assembly 1 can be exchanged for another when required for maintenance reasons, or when replacing a spinning rotor. When in operation the opening 9 is closed by means of a hinged cover 11 used for maintenance purposes and sealed by means of a circular washer 10.

The rotor 2 of the spinning rotor assembly 1 has a hollow chamber 12, which, from its open side contains a conically expanding fiber sliding surface 13, as shown in FIG. 1, which extends up to a fiber collecting groove 14. When in operation, a constructed component 15, which is a continuation of the cover 11, projects into the rotor chamber 12. When in operation, an overflow gap 16 is retained between this component 15 and the rotor 2 to permit the spinning air to stream off so that the vacuum in the vacuum chamber 4 can also be effective in the chamber of the spinning rotor 1.

The cover 11 contains the part of a fiber feed duct 17 which is facing the spinning rotor assembly 1, the mouth 18 of the fiber feed duct 17 being so arranged in the component 15 that it lies—in the area of the open front side of the rotor 2—very close to the sliding surface 13, with a component in the sense of rotation D of the spinning rotor 1, (see in addition FIG. 5 which is described later in the text). On the side of the fiber collecting groove 14 there is a so-called navel 19, arranged on the component 15 and co-axially situated to the axis of the spinning rotor 1, in which a yarn withdrawal duct 20 begins.

When the arrangement for open-end rotor spinning is in operation, separated fibers 21 are fed in in a known way by an opening roller (not shown) in arrow direction A through the fiber feed duct 17 into the chamber 12 of the spinning rotor 1 by means of a transport air flow created by the vacuum source. The fibers 21 exit through the mouth 18 of the fiber feed duct 17 and reach the fiber sliding surface 13 with a component in the sense of rotation D of the spinning rotor 1 from where they slide into the fiber collecting groove 14 in a way which has not yet been described. As a result of the high number of revolutions per minute of the spinning rotor 1, the separated fibers 21 collect in the fiber collecting groove 14 and form a still loose fiber ring 22, to which the collected fibers 21 are doubled. The spun thread 23 is then pulled through the navel 19 and the yarn withdrawal duct 20 in arrow direction B in a known manner and fed to a wind-up device (not shown).

In FIG. 1 which shows a fiber collecting surface 13 expanding conically, the fibers can slide into the fiber collecting groove 14 by means of centrifugal forces. This invention will show how the fibers 21 on the fiber sliding surface 13 can slide into the fiber collecting groove 14, even when no or only very weak centrifugal forces exist. For this purpose the fiber sliding surface 13 is provided with structured areas 24, whose function will be illustrated in the following with the aid of FIGS. 1A, 2 and 3.

Figure 1A:
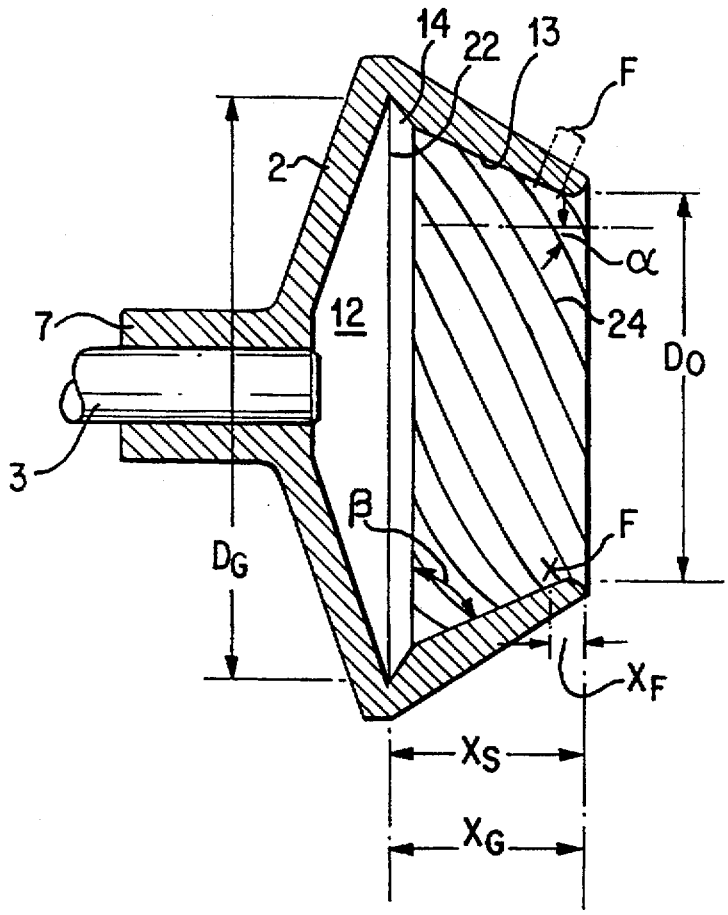
FIG. 1A is a sectional view of the rotor of FIG. 1, with depiction of preferred dimensions of same.

FIG. 1A is a sectional view of the rotor of FIG. 1, marked to show dimensions contemplated for certain preferred embodiments of the invention. DG is the diameter of the collecting groove, a dimension which establishes the diameter of the rotor. Collecting groove diameter DG is maximally 30 mm in especially preferred embodiments, thereby facilitating very high rotational speed spinning. The diameter Do of the opening into the rotor is preferably in the range of 20 mm to 25 mm and the axial distance X from the collecting groove to the rotor opening is at least 10 mm and preferably between 10 mm and 15 mm. The axial distance Xs for the fiber sliding surface between the center of the area of fiber impact F and the collecting groove is preferably at least 8 mm.

The angular inclination $\beta$ of the sliding surface 13 with respect to a radial plane is preferably more than 77.5°, thereby assuring a sufficiently large opening Do for accommodating the component 15 and supply of fibers to the sliding surface, even with the contemplated small collecting grooves of less than 30 mm diameter. The angle of inclination $\alpha$ of the profiles is preferably between 30° and 40°. As shown FIGS. 1 and 1A, the rotational direction of the rotor is clockwise, when viewed in the direction from right to left into the open side of the rotor.

Figure 2:
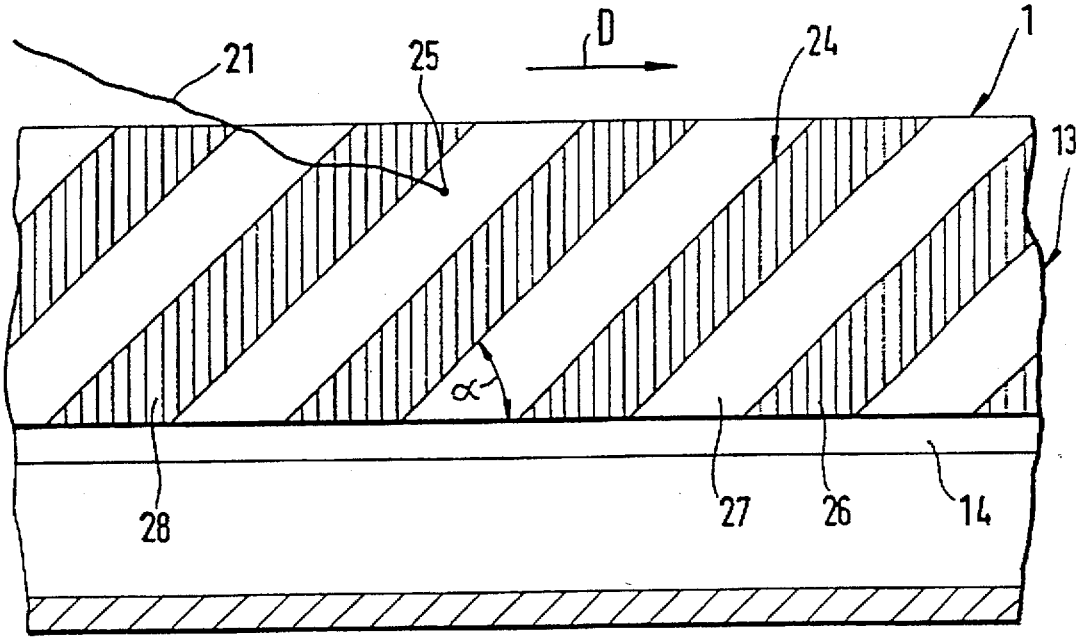
FIG. 2 is a detail of the fiber sliding surface of the spinning rotor to illustrate the propelling force of the structured areas, shown as a developed view.
Figure 3:
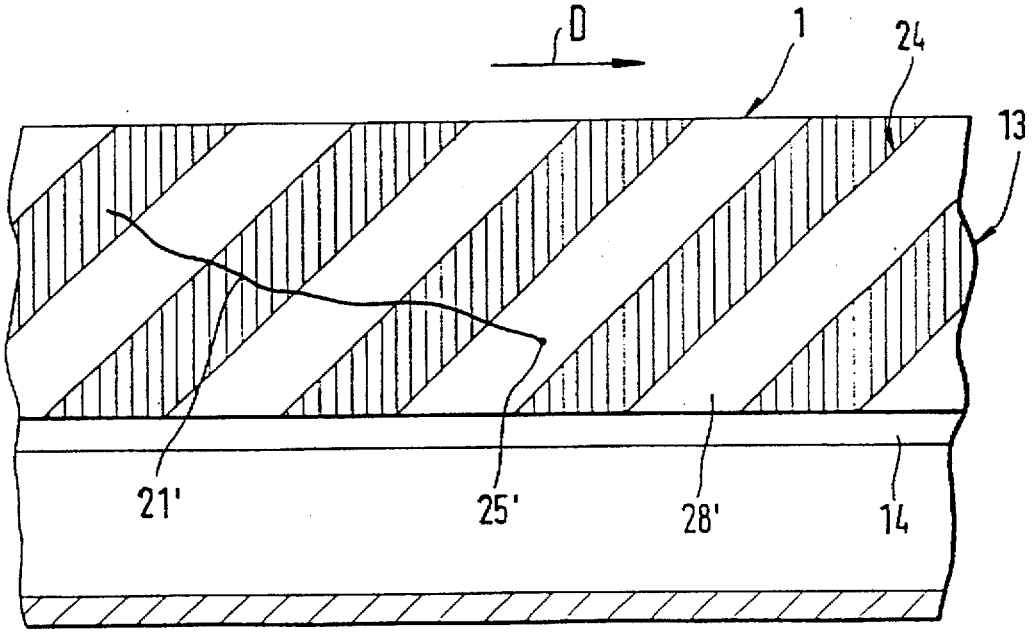
FIG. 3 is the fiber sliding surface according to FIG. 2, at a very short time later.

FIGS. 2 and 3 show in enlarged detail and as a developed view, the same fiber sliding surfaces 13 rotating in arrow direction D at two closely following points in time. Structured areas 24 can be seen, which are designed at a certain angle of inclination $\alpha$ on the fiber sliding surface 13, and which expand to the fiber collecting groove 14. As seen from the open front side in the direction of the fiber collecting groove 14, the structured areas 24 are arranged against the sense of rotation D of the spinning rotor 1. In the development according to FIGS. 2 and 3, the structured areas 24 consist of notches 26 and elevations 27, which constantly alternate with each other. The angle of inclination can be, for example 45°. The design of the structured areas 24 will be illustrated later in detail with the aid of FIGS. 6 to 15.

FIGS. 2 and 3, as already mentioned, represent two states one directly following the other. In FIG. 2, a fiber 21 exiting from the mouth 18 of the fiber feed duct 17 has just reached the fiber sliding surface 13 with its leading end 25. It can be seen that the fiber 21 is provided with a component in the sense of rotation D of the spinning rotor 1 and which is also slightly inclined in the direction of the fiber collecting groove 14. Directly upstream from the leading end 25 the fiber 21 rests in a notch 26 and covers an adjacent elevation 27.

In FIG. 3 the same fiber 21 has moved to position 21' in arrow direction D. The fiber 21 has simultaneously slid a small way in the direction of the fiber collecting groove 14 along the fiber sliding surface 13 and now lies completely on the fiber sliding surface 13. At the same time the fiber sliding surface 13 has moved quite a way onwards in arrow direction D. This can be seen from the notch marked with a special reference symbol 28 on the structured areas 24, namely in that this notch 28, according to FIG. 3, has moved to the position 28', where it is slightly ahead of the position 25' of the leading end 25. This is because the fiber sliding surface 13 has, in that moment when a fiber 21 reaches it, a much faster circumferential speed than the fiber 21. This relative velocity is on the other hand necessary in order that the structured areas 24—apart from the effect of the centrifugal forces—can transport the fiber 21 to the fiber collecting groove 14.

It is assumed that the fiber 21 in question comes to rest in a notch 26 and then takes on the shape of the elevation 27, and comes to rest again in a neighboring notch 28. In this way the structured areas 24 of the fiber sliding surface 13 exert an influence on the movement of the fiber 21.

Firstly the fiber 21, having reached the fiber sliding surface 13 is accelerated more and more in the sense of rotation D of the spinning rotor 1, and secondly a centrifugal force is created by this acceleration whereby the fiber 21 is pressed more and more strongly against the fiber sliding surface 13. At the beginning, when the difference in velocity between the fiber 21 and the fiber sliding surface 13 is at its greatest, a centrifugal force hardly exists. While the acceleration continues, there is a difference of velocity. The fiber sliding surface 13 slides to a certain extent under the fiber 21. Subsequently the frictional forces become more effective, whereby the transport effect of the structured areas 24 diminishes Were the structured areas 24 not arranged against the sense of rotation D, as seen in the direction towards the fiber collecting groove 14, then there would be a transport effect away from the fiber collecting groove 14. The direction of the structured areas 24 is therefore important.

The fiber sliding surface 13, provided with structured areas 24 according to the invention can, with regard to its angle of taper, be steeper than a fiber sliding surface without structured areas. To the centrifugal forces which effect a sliding of the fibers 21 into the fiber collecting groove 14 in traditional spinning rotors 1, comes the added transport effect of the structured areas 24. The steeper the fiber sliding surface 13 is, the more the sliding of the fibers 21 is effected by the structured areas 24. Transport is effected solely by the structured areas 24 when the fiber sliding surface 13 is vertical, that is cylindrical.

As soon as the velocity of the delivered fibers 21 has reached that of the circumferential velocity of the fiber sliding surface 13, the propelling force of the structured areas 24 diminishes. Tests are necessary to ascertain the required length of the structured areas 24. They do not have to reach as far as the fiber collecting groove 14. The optimal angle α which is preferably between 30° and 40° as noted above with reference to FIG. 1A, must also be ascertained by means of tests, as must the depth of the notches 27 as well as their width.

Figure 4:
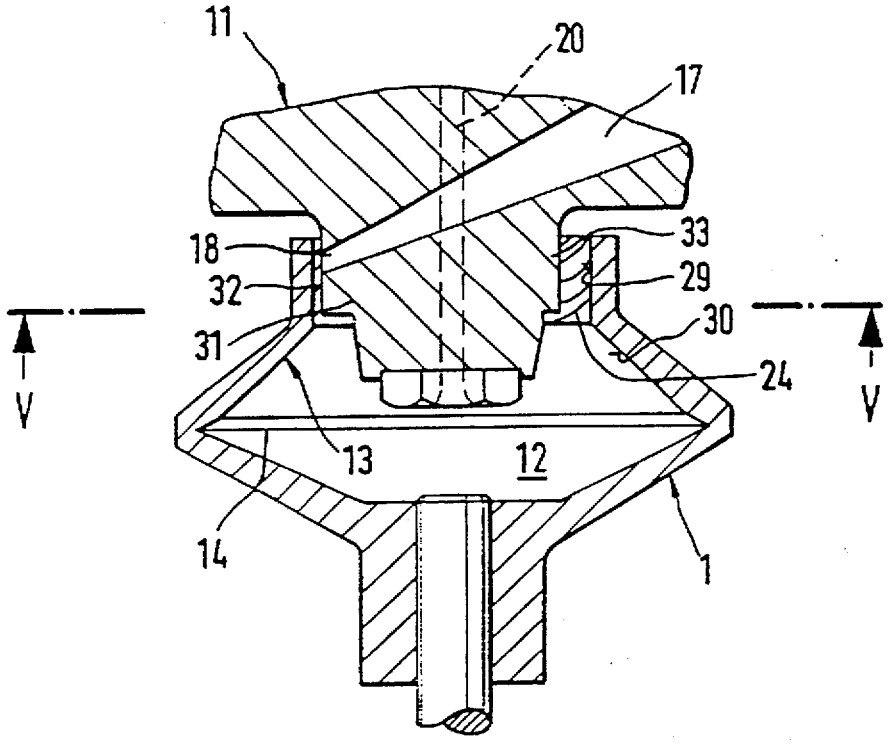
FIG. 4 is a longitudinal section through the area of a slightly different spinning rotor assembly with structured areas according to another preferred embodiment of the invention.
Figure 5:
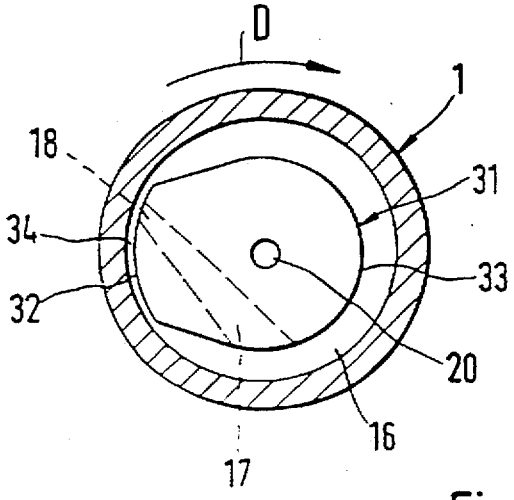
FIG. 5 is a sectional view along the section surface V—V of FIG. 4.
Figure 6:
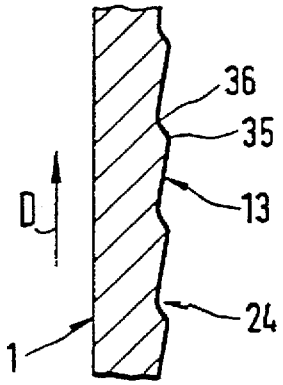
FIGS. 6 to 15 are very enlarged drawings of a part of the spinning rotor shown in FIG. 4, with however varying structured areas according to preferred embodiments of the present invention.

FIGS. 4 and 5 show an advantage of the invention, namely that the inlet opening of the spinning rotor 1 can be enlarged, in comparison to a spinning rotor whose fiber sliding surface 13 is entirely conically formed. With the structured areas 24 it is now possible to design the first part of the fiber sliding surface 13 as a cylindrical surface 29, as the relative velocity between the spinning rotor 1 and the delivered fibers 21 is at its greatest here. The cylindrical surface 29 is then provided with the structured areas 24. As soon as the propelling force diminishes after the relative velocity between the spinning rotor 1 and the fibers 21 has reached zero, the fiber sliding surface 13 is designed as a conical surface 30, along which the centrifugal forces effect the transport of the fibers 21 fully into the fiber collecting groove 14. The transition point between the cylindrical surface 29 and the conical surface 30 is appropriately ascertained by means of tests. The part of the fiber sliding surface 13 which is designed as a cylindrical surface 29 makes it possible not only to make the mouth 18 of the component 31 containing the fiber feed duct 17 larger, whereby more space is gained for also arranging for example, a yarn withdrawal duct, but also, due to the cylindrical design, to make the component 31 itself cylindrical. In this way the mouth 18 of the fiber feed duct 17 can be brought much nearer to the fiber sliding surface 13. The delivered fibers 21 reach with certainty the fiber sliding surface 13 first, and not directly the fiber collecting groove 14, as is sometimes the case with traditional spinning rotors. The sliding along the fiber sliding surface 13 is advantageous, as a straightening of the fibers 21 is thereby assisted.

It must of course be observed in the design according to FIGS. 4 and 5, that is when there is a very small gap between the mouth 18 and the cylindrical surface 29, that the spinning air can escape from the interior chamber 12 of the spinning rotor 1. For this reason the overflow gap 16 is designed wider in an area where the mouth 18 is not found, as can be seen in particular in FIG. 5.

Also to be seen in FIG. 5 is the fiber feed duct 17, disposed with a component in the sense of rotation D of the spinning rotor 1. This component in the sense of rotation is provided in all the design drawings.

The component 31 projecting into the interior chamber 12 of the spinning rotor 1 is designed in such a way that, as in FIG. 5, it has a first contour 32 in the area of the mouth 18 of the fiber feed duct 17 and a second contour 33 in the area distant from the mouth 18, the first contour 32 being nearer to the fiber sliding surface 13 than the second contour 33. This means that a larger overflow gap 16 is formed in the latter area, while in the former area there is a relatively narrow overflow gap 34.

With the aid of the enlarged drawings according to FIGS. 6 to 15, the following varying designs of the structured areas 24 will be described. They concern predominantly structured areas containing notches or grooves.

The spinning rotors 1 each rotate in arrow direction D. Structured areas 24 according to FIG. 6, which have an asymmetrical pattern containing both grooves 36 and elevations 35, are practical for many uses. They exert a particularly good propelling force on the fibers 21 in the direction of the fiber collecting groove 14.

Figure 7:
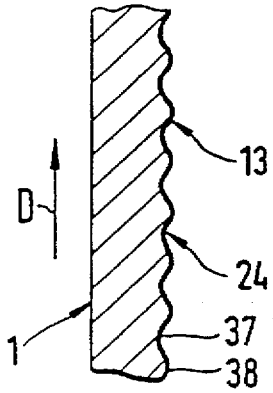

The grooved pattern of the fiber sliding surface 13 according to FIG. 7 is, in contrast, regular; it has notches 37 and elevations 38 which are each equally wide. In this case particularly smooth, wave-shaped structured areas 24 are involved.

Figure 8:
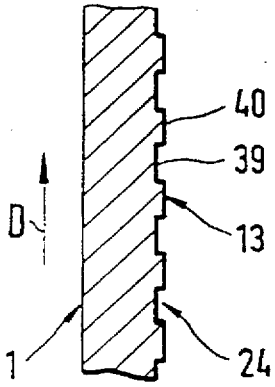

The embodiment according to FIG. 8 shows angular structured areas 24 which afford a particularly good grip. Notches 39 alternate with equally wide elevations 40, whereby there is a very sharp-edged transition.

Figure 9:
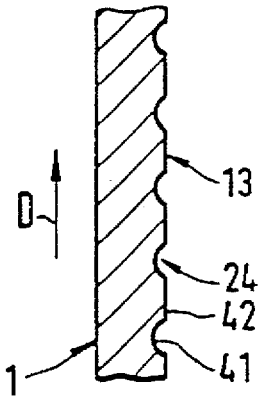

The design according to FIG. 9 shows a fiber sliding surface 13, having half-cylindrical grooves 41 with relatively large distances between each other, and between which are wide elevations 42°. The transition is thereby relatively sharp-edged.

Figure 10:
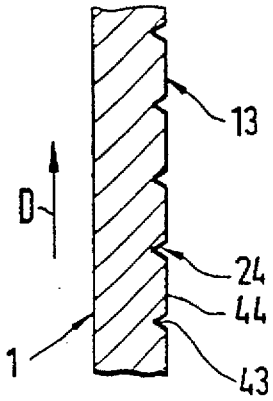

The design according to FIG. 10 is even more aggressive, the groove-like notches 43 of the fiber sliding surface 13 having a V-shape. The individual notches 43 are separated from each other by wider elevations 44.

Figure 11:
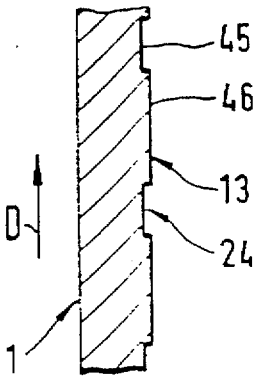

The design according to FIG. 11 is practically the same design as in FIG. 8 with the difference that the angular notches 45 have a larger distance between each other, so that there are wider elevations 46 between them.

Figure 12:
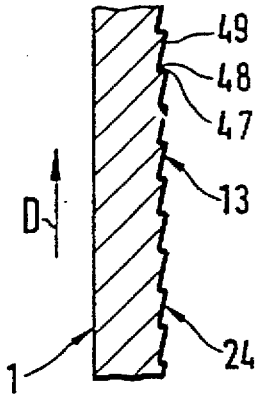

The structured areas 24 according to FIG. 12 are saw toothlike, so that particularly good propelling forces are created. Here groove-like notches 48 are involved which have an asymmetrical profile. On one side there is a relatively sharp edge 47, on the other side—in the sense of rotation D—it tapers off smoothly (reference number 49).

Figure 13:
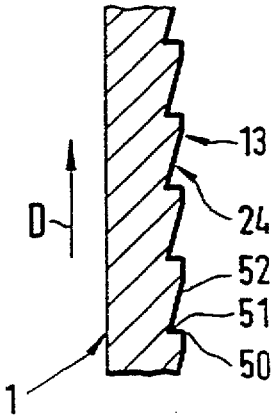

The design according to FIG. 13 is similar to that according to FIG. 12 with the difference that the notches 51 following the edges 50 are bigger and the smooth tapering-off is longer.

Figure 14:
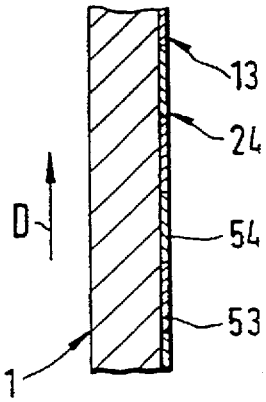

The design according to FIG. 14 deviates from the structured areas 24 described up to now in that there are no grooved structured areas, rather areas 53 and 54, having varying coefficients of friction, which alternate continuously with each other. These coefficients of friction can be achieved by coating the fiber sliding surface 13 appropriately. The structured areas 24, consisting of the areas 53 and 54 with varying coefficients of friction are, in the same way as has been described up to now, inclined against the sense of rotation D towards the fiber collecting groove 14, which means that the coatings are to a certain extent applied as spiral lines.

Figure 15:
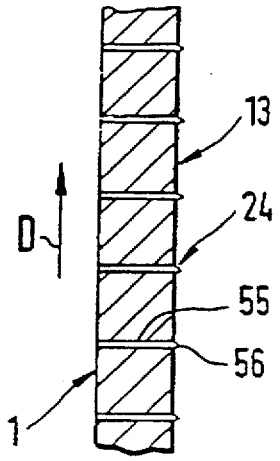
Figure 16:
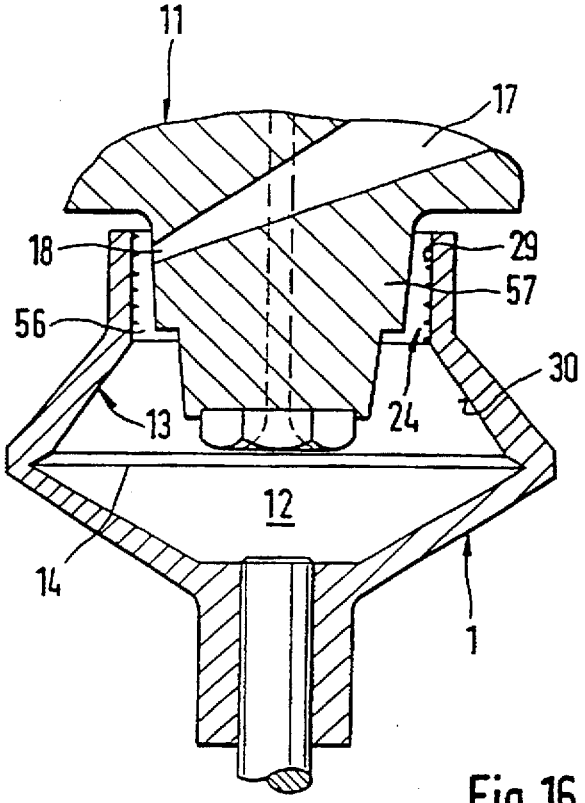
FIG. 16 is a longitudinal sectional view of a rotor assembly similar to FIG. 4 with structured areas according to FIG. 15.

In the design according to FIG. 15 thin needles 55 are set into the fiber sliding surface 13 at certain intervals, whose tips 56 project about 0,1 mm outwards from the fiber sliding surface 13. These tips 56, as can be seen in particular in FIG. 16, can have an additional separating effect on the fibers delivered from the mouth 18 of the fiber feed duct 17, similar to the effect of an opening roller. Accumulations of fibers in the area where the fiber sliding surface 13 begins are reduced. Otherwise, the fiber sliding surface 13 is designed in two parts according to FIG. 16. The first part provided with the structured areas 24 is formed as a cylindrical surface 29 and the second part leading to the fiber collecting groove 14 is formed as a conical surface 30. The component 57 which contains the mouth 18 of the fiber feed duct 17 and which projects into the interior chamber 12 of the spinning rotor 1 is here, to facilitate moving it aside, slightly conically formed.

Figure 17:
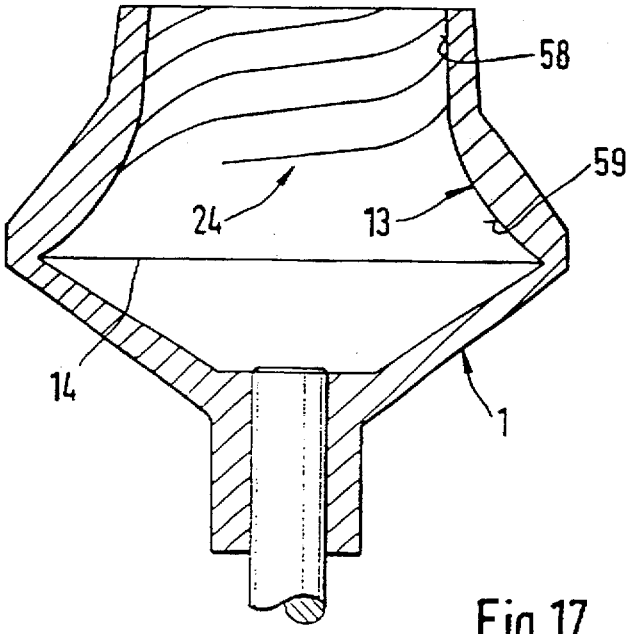
FIGS. 17 to 21 are each a longitudinal sectional view similar to FIG. 4, showing further preferred embodiments of the invention.

The design of the fiber sliding surface 13 in spinning rotors 1 according to FIG. 17 is interesting, although from the point of view of fabrication more complicated. The area of the fiber sliding surface 13 which is distant from the fiber collecting groove 14 is very steep, where required cylindrical, while the diameter of the fiber sliding surface 13 facing the fiber collecting groove 14 increases continuously. The fact is taken into consideration that the relative velocity between the fiber sliding surface 13 and the delivered fibers 21 is at its highest in the area 58 and that in a later area 59 the relative velocity is practically zero. Accordingly the structured areas 24 will stop where the velocity of the fibers 21 has reached the same level as that of the circumferential velocity of the fiber sliding surface 13. In the area directly upstream from the fiber collecting groove 14 it is only the centrifugal forces that still have an effect. It is therefore purposeful in that part which is not provided with structured areas to let the slippage resistance towards the fiber collecting groove 14 decrease continuously in order to adapt to the form of the fiber sliding surface 13.

Figure 18:
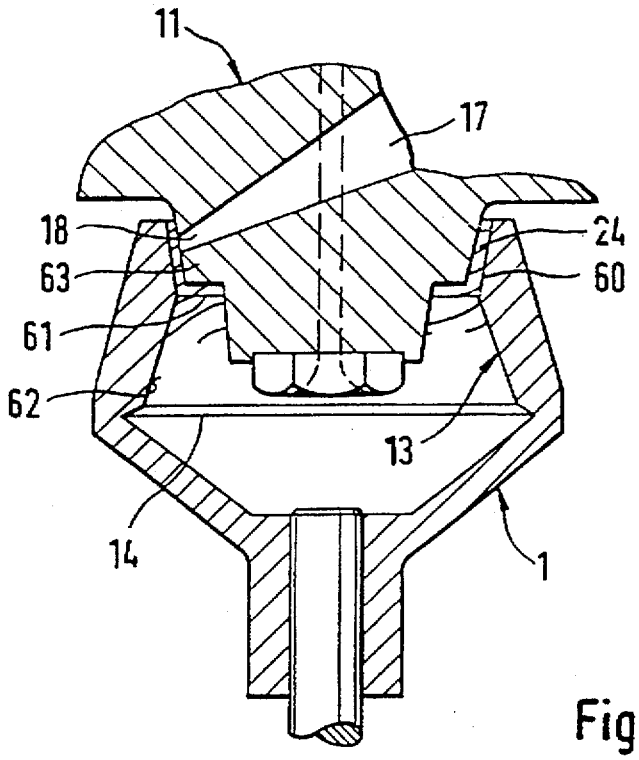

As the structured areas 24 are able to transport the fibers 21 to the fiber collecting groove 14 even without the centrifugal forces, the design in FIG. 18 can be thus that the fiber sliding surface 13 has a conical surface 60 on the inlet side of the spinning rotor 1 which inclines lightly outwards. In this case even the centrifugal forces must be overcome when the fibers 21 slide into the fiber collecting groove 14. Directly downstream from this the fiber sliding surface 13 is provided with a conical surface 62, which begins on an edge 61 and from which point the transport of the fibers is solely effected by the centrifugal forces.

The design according to FIG. 18 has the big advantage that, despite the very small gap between the mouth 18 of the fiber feed duct 17 and the fiber sliding surface 13, it is possible to move the component 63 to the side for maintenance purposes. The component 63 can thereby taper off conically towards the fiber collecting groove 14, without the gap to the conical surface 60 changing.

Figure 19:
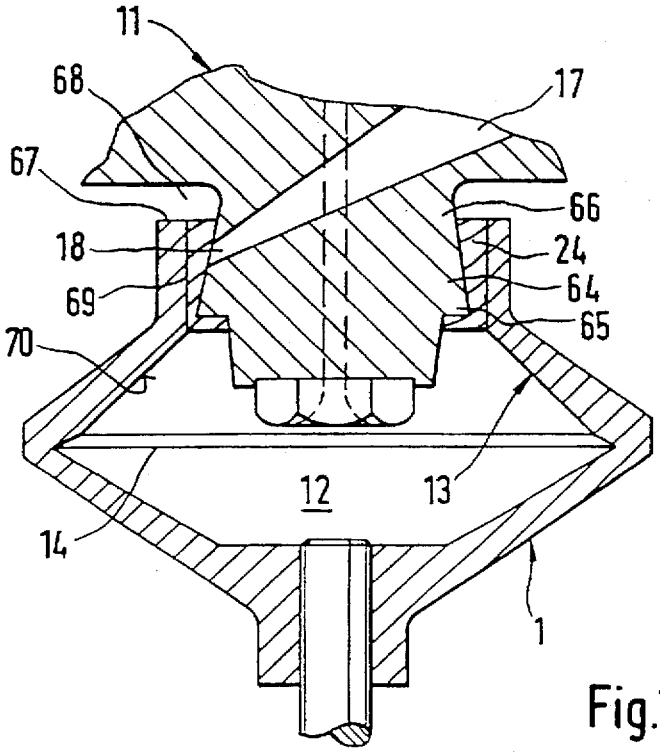

In the design according to FIG. 19 a fiber sliding surface 13 is again provided, which begins with a cylindrical surface 69 and joins up to an adjacent conical surface 70 towards the fiber collecting groove 14. The structured areas 24 are intended only for the area of the cylindrical surface 69. The component 64 which projects into the interior chamber 12 of the spinning rotor 1 and which contains the mouth 18 of the fiber feed duct 17 expands conically towards the fiber collecting groove 14, that is, there is a larger gap between the area 66 of the component 64 and the cylindrical surface 69 than between the component 64 and the adjacent area 65. This development has the advantage that transport air which reaches the interior chamber 12 of the spinning rotor 1 through the fiber feed duct 17 can escape better through the overflow gap 68, that is, over the open edge 67 of the spinning rotor 1. With this design the transporting of the delivered fibers 21 directly into the fiber collecting groove 14, without any contact with the fiber sliding surface 13 is, with certainty, avoided.

Figure 20:
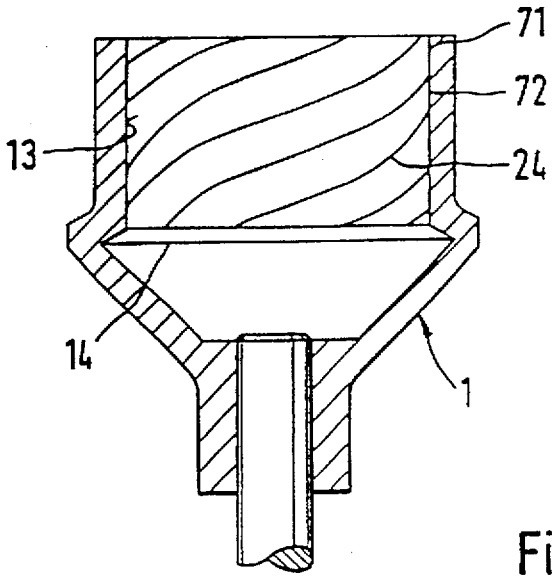

The embodiment according to FIG. 20 makes it even possible to use spinning rotors 1 whose fiber sliding surface 13 has a continuous cylindrical surface 72 expanding from the open edge 71 of the spinning rotor 1 to the fiber collecting groove 14, the cylindrical surface 72 being provided with structured areas 24. In this design, the centrifugal forces do not contribute to the transporting of the fibers 21 to the fiber collecting groove 14, rather the transporting is effected solely by the structured areas 24. The fiber sliding surface 13 may of course be only so long that a certain relative velocity between the delivered fibers 21 and the circumferential velocity of the fiber sliding surface 13 exists, that is, only so long that the velocities have not reached the same level. Such a spinning rotor 1 is particularly advantageous to manufacture, especially when one of the grooved forms already described is used for structured areas 24.

Figure 21:
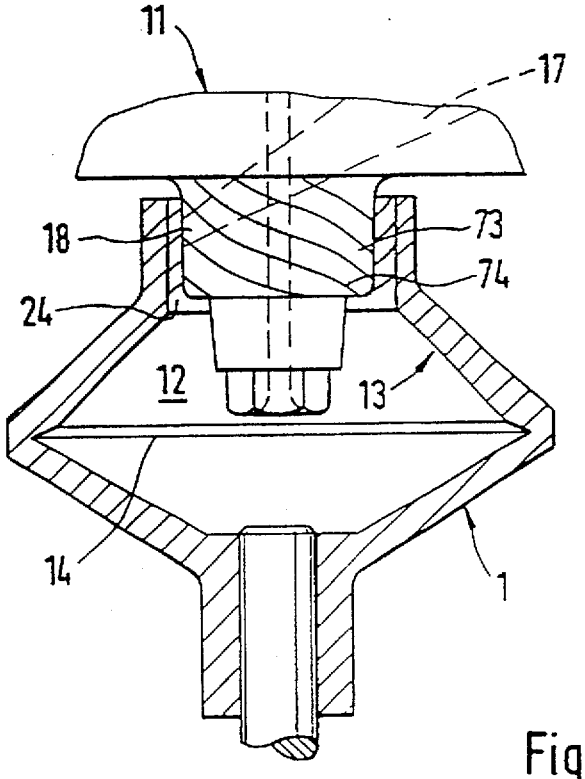

The design according to FIG. 21 differs from the embodiments already described in that the component 73 which projects into the interior chamber 12 of the spinning rotor 1 is also provided with structured areas 74. The component 73 is stationary. The air is driven by the spinning rotor 1 and moves in a circle. A spiral air current is thus created with the aim of transporting the fibers 21 into the fiber collecting groove 14.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning rotor for an open-end spinning machine of the type including a drive for rotating the rotor and a fiber feeding duct for feeding fibers to be spun to the rotor, said spinning rotor comprising:

a fiber collecting groove, and a fiber sliding surface extending from adjacent an opening of the fiber feeding duct to the fiber collecting groove, wherein said fiber sliding surface is provided with at least one structured surface area which is configured to impart a transporting force on the fibers in a direction towards the fiber collecting groove during rotation of the rotor during normal spinning operation.

2. A spinning rotor according to claim 1, wherein the at least one structured surface area is formed by at least one of elevations and notches in the fiber sliding surface.

3. A spinning rotor according to claim 1, wherein the at least one structured area includes a plurality of structured areas formed with varying coefficients of friction.

4. A spinning rotor according to claim 1, wherein the at least one structured area includes a needle-like fitting.

5. A spinning rotor according to claim 1, wherein the fiber sliding surface is at least partly formed as a cylindrical surface.

6. A spinning rotor according to claim 1, wherein the fiber sliding surface is formed as a conical surface expanding towards the fiber collecting groove, at least in the area directly preceding the fiber collecting groove.

7. A spinning rotor according to claim 1, wherein the incline of the fiber sliding surface increases towards the fiber collecting groove in a longitudinal direction of the spinning rotor.

8. A spinning rotor according to claim 1, wherein an end portion of the fiber sliding surface distant from the fiber collecting groove widens conically outwards.

9. A spinning rotor according to claim 1, wherein the mouth of the fiber feeding duct is arranged in a component partly projecting into an interior chamber of the spinning rotor, which component in the area of the mouth reaches almost to the fiber sliding surface and which expands in axial direction, preferably in conical form, to the fiber collecting groove.

10. A spinning rotor according to claim 1, wherein said at least one structured surface area includes a plurality of structured surface area strips arranged symmetrically around a rotor rotational axis, each of said strips extending toward the collecting groove at an angle $\alpha$ between 30° and 40° with respect to a radial plane of said rotor and in a direction opposite the circumferential direction of movement of the fiber sliding surface.

11. A spinning rotor according to claim 10, wherein said fiber sliding surface is inclined by an angle $\beta$ of more than 77.5° with respect to a radial plane of said rotor.

12. A spinning rotor according to claim 11, wherein said fiber sliding surface has an axial length from a mid-point of a fiber impact area facing the opening of the fiber feeding duct to the fiber collecting groove of at least 8 mm.

13. A spinning rotor according to claim 12, wherein said fiber collecting groove has a diameter less than 30 mm.

14. A spinning rotor according to claim 11, wherein said fiber collecting groove has a diameter less than 30 mm.

15. A spinning rotor according to claim 10, wherein said fiber sliding surface has an axial length from a mid-point of a fiber impact area facing the opening of the fiber feeding duct to the fiber collecting groove of at least 8 mm.

16. A spinning rotor according to claim 15, wherein said fiber collecting groove has a diameter less than 30 mm.

17. A spinning rotor according to claim 10, wherein said fiber collecting groove has a diameter less than 30 mm.

18. A spinning rotor according to claim 1, wherein said fiber sliding surface is inclined by an angle $\beta$ of more than 77.5° with respect to a radial plane of said rotor.

19. A spinning rotor according to claim 18, wherein said fiber sliding surface has an axial length from a mid-point of a fiber impact area facing the opening of the fiber feeding duct to the fiber collecting groove of at least 8 mm.

20. A spinning rotor according to claim 19, wherein said fiber collecting groove has a diameter less than 30 mm.

21. A spinning rotor according to claim 18, wherein said fiber collecting groove has a diameter less than 30 mm.

22. A spinning rotor according to claim 1, wherein said fiber sliding surface has an axial length from a mid-point of a fiber impact area facing the opening of the fiber feeding duct to the fiber collecting groove of at least 8 mm.

23. A spinning rotor according to claim 22, wherein said fiber collecting groove has a diameter less than 30 mm.

24. A spinning rotor according to claim 1, wherein said fiber collecting groove has a diameter less than 30 mm.

* * * * *